US006275671B1

(12) United States Patent
Hamada et al.

(10) Patent No.: US 6,275,671 B1
(45) Date of Patent: Aug. 14, 2001

(54) IMAGE FORMING APPARATUS WITH CLEANABLE TRANSFER ROLLER

(75) Inventors: Toshiyuki Hamada, Osaka; Tetsuro Tomoe, Nara-ken; Tadahiro Kiyosumi, Tenri; Naoyuki Ishida, Shijyonawate, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/467,261

(22) Filed: Dec. 20, 1999

(30) Foreign Application Priority Data

Dec. 22, 1998 (JP) ..... 10-365498

(51) Int. Cl.[7] ..... G03G 21/00
(52) U.S. Cl. ..... 399/101; 399/313
(58) Field of Search ..... 399/99–101, 313, 399/314

(56) References Cited

U.S. PATENT DOCUMENTS 5,572,305 * 11/1996 Hayashi et al. ..... 399/313 X
5,689,771 * 11/1997 Sato et al. ..... 399/101
5,729,810 * 3/1998 Bergen et al. ..... 399/313
5,828,938 * 10/1998 Hazama et al. ..... 399/313
5,867,761 * 2/1999 Ishida et al. ..... 399/314 X
5,970,297 * 10/1999 Gross ..... 399/313

* cited by examiner

*Primary Examiner*—William J. Royer
(74) *Attorney, Agent, or Firm*—Jordan and Hamburg LLP

(57) ABSTRACT

A transfer roller is spaced away from the outer surface of a photosensitive drum by a specified distance to prevent the abrasion and damage of the photosensitive drum by the contact of the transfer roller and the photosensitive drum. The transfer roller not in contact with the photosensitive drum can be formed to have a sufficient hardness without damaging the outer surface of the photosensitive drum. Further, since the transfer roller has a sufficient hardness, cleaning blades can be held in without damaging the transfer roller with a sufficiently large force without damaging the transfer roller, thereby securely scraping off toner and the line adhered to the transfer roller and preventing the rear surface of a transfer sheet from being smeared.

9 Claims, 5 Drawing Sheets

IMAGE FORMING APPARATUS WITH CLEANABLE TRANSFER ROLLER

This application is based on patent application No. 10-365498 filed in Japan, the contents of which are hereby incorporated by references.

BACKGROUND OF THE INVENTION

1. Field of the Invention

This invention relates to an image forming apparatus, such as copier, facsimile, and printer, using an electrophotographic process.

2. Description of the Background Art

In an image forming apparatus using an electrophotographic process such as copier, facsimile and printer, the following devices are arranged around a photosensitive body having photoconductivity along a rotating direction of the photosensitive body: a charger, an exposing device, a developing device, a transfer device, a charge removing device, a cleaner, etc. The charger gives a specified potential to the outer surface of the photosensitive body by corona discharge from a charging wire to which a high-tension voltage is applied. The exposing device selectively attenuates the potential of the outer surface of the photosensitive body by projecting a light corresponding to a desired image, thereby forming an electrostatic latent image. The developing device develops the electrostatic latent image formed on the photosensitive body by toner, thereby forming a toner image. The transfer device transfers the toner image formed on the photosensitive body to a transfer sheet. The charge removing device removes electric charges on the outer surface of the photosensitive body. The cleaner removes the toner residual on the outer surface of the photosensitive body.

If a transfer roller is used as the transfer device in such an image forming apparatus, it is normally pressed against the photosensitive body at a specified pressure. The toner image formed on the outer surface of the photosensitive body is transferred to the transfer sheet held between the transfer roller and the photosensitive body by applying a transfer output having a polarity opposite to that of the toner image to the transfer roller.

A known cleaning means for removing external matters such as toner and paper powder adhered to such a transfer roller is such that a cleaning blade formed of an elastic member is held in contact with the transfer roller to scrape off the toner and paper powder adhered to the outer surface of the transfer roller (see Japanese Unexamined Patent Publication No. 8-240998).

In such an image forming apparatus, the transfer roller held in contact with the outer surface of the photosensitive body is required to be made of a soft material in order to increase the lifetime of the photosensitive body by suppressing the abrasion of a photosensitive layer of the photosensitive body. However, if the transfer roller is made of a soft material, the cleaning blade held in contact therewith is also required to be made of a soft material in order not to damage or scratch the outer surface of the transfer roller. In addition, this cleaning blade needs to be held in contact with the transfer roller with a small pressing force.

Accordingly, in order to enable the cleaning blade to be securely held in contact with the transfer roller with a small pressing force, it is required to be highly accurately positioned with respect to the transfer roller. For this purpose, the conventional image forming apparatuses are provided with an adjusting mechanism for finely adjusting the mount position of the cleaning blade. However, such a mechanism results in an increased production cost of the image forming apparatus and necessitates an adjustment of the mount position of the cleaning blade if the cleaning blade is abraded.

Even if such an adjusting mechanism is provided, there are many cases where the toner and paper powder adhered to the outer surface of the transfer roller cannot be sufficiently removed since the cleaning blade is held in contact with the transfer roller with a small pressing force. This may cause the toner to smear the rear surface of the sheet and the remaining external matter such as paper powder to be pressed against the outer surface of the photosensitive body, thereby destroying or damaging it.

SUMMARY OF THE INVENTION

It is an object of the invention to provide an image forming apparatus which has overcome the problems residing in the prior art.

It is another object of the invention to provide an image forming apparatus which is inexpensive and can ensure a stable formation of high-quality image while increasing the lifetime of a photosensitive body.

According to an aspect of the invention, an image forming apparatus comprises a photosensitive body on which a toner image is to be formed; a transfer roller spaced away from the outer surface of the photosensitive body by a specified distance for transferring the toner image formed on the photosensitive body to a sheet; and a cleaning blade held in contact with the transfer roller for scraping off toner adhered to the transfer roller.

With the image forming apparatus thus constructed, since the transfer roller is not in contact with the photosensitive body, it can have a sufficient hardness and a surface roughness suited to the particle diameter of the toner without damaging the outer surface of the photosensitive drum. Thus, the cleaning blade held in contact with the transfer roller need not be made of a soft material lest the outer surface of the transfer roller should be damaged. Further, since the cleaning blade can be pressed against the transfer roller with a strong force, an adjuster for finely adjusting the mount position of the cleaning blade is not necessary. Therefore, while the production cost of the apparatus can be reduced by forming the cleaning blade of an inexpensive elastic member and simplifying the mount construction of the cleaning blade, the toner and the like adhered to the transfer roller can be securely removed by pressing the cleaning blade against the transfer roller with a large force. This in turn prevents the rear surface of the transfer sheets from being smeared and ensures a stable image formation of high quality.

DETAILED DESCRIPTION OF THE PREFERRED EMBODIMENTS OF THE INVENTION

In the following description, after the overall construction of a copier according to one embodiment of the invention is described, the construction of a transfer roller and devices around it which is a characteristic portion of the invention is described.

Figure 1:
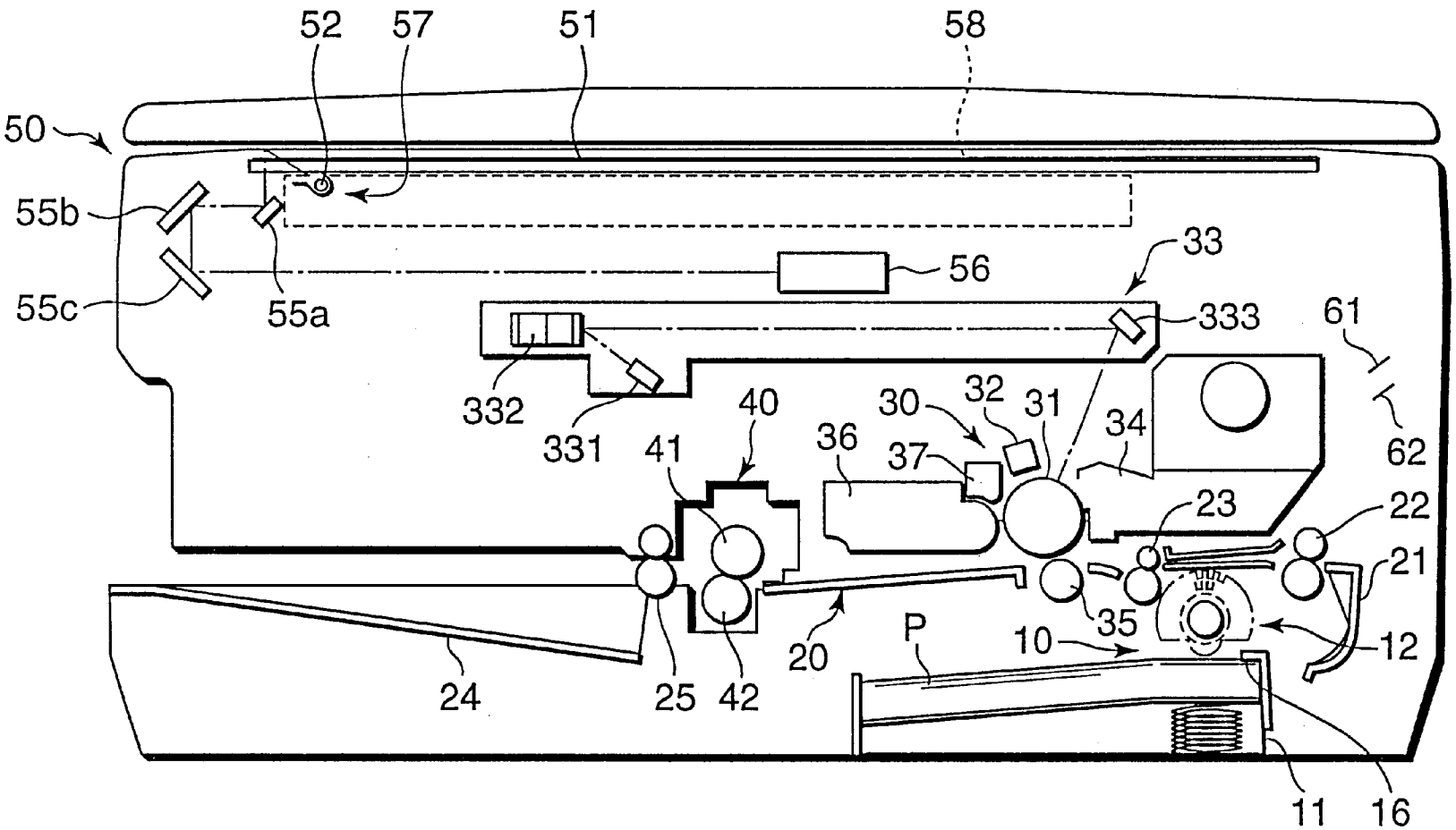
FIG. 1 is a schematic diagram showing a construction of an image forming apparatus according to an embodiment of the invention.

FIG. 1 is a schematic diagram showing a construction of a copier according to one embodiment of the invention. This copier is provided with a sheet feeder 10 at the bottom of an apparatus main body, a sheet transporting assembly 20 above the sheet feeder 10, an image transferring assembly 30 above the sheet transporting assembly 20, a fixing assembly 40 in a position more toward a sheet discharging side, and an image reading assembly 50 comprised of optical members. The image reading assembly 50 is provided above the image transferring assembly 30 and the fixing assembly 40.

The sheet feeder 10 feeds transfer sheets P stacked on a sheet cassette 11 toward an outlet (right side in FIG. 1) of the sheet cassette 11 by the rotation of a feed roller 12 having an arcuate periphery. Further, uppermost transfer sheets P can be securely dispensed one by one by being separated by separating claws 16 provided at the upper opposite ends of the sheet cassette 11 with respect to its widthwise direction.

The sheet transporting assembly 20 transports the transfer sheet P fed from the sheet cassette 11 to the image transferring assembly 30 by a pair of transport rollers 22 and a pair of registration rollers 23 via a reversing guide 21, and further discharges the transfer sheet P having an image formed in the fixing assembly 40 from the image transferring assembly 30 onto a discharge tray 24 by a pair of discharge rollers 25.

The image transferring assembly 30 forms a specified toner image on the transfer sheet P by the electrophotographic process and includes a rotatably supported photoconductive photosensitive drum 31, a charger 32, an exposing device 33, a developing device 34, a transfer device 35, a cleaner 36 and a charge removing device 37 which are arranged around the photosensitive drum 31 along its rotating direction.

The charger 32 is provided with a charging wire (not shown) to which a high-tension voltage is applied, and gives a specified potential to the outer surface of the photosensitive drum 31 by corona discharge from this charging wire. The exposing device 33 projects a laser beam outputted from a laser emitter 331 based on image data of an original read by the image reading assembly 50 to be describe later onto the photosensitive drum 31 via a polygonal mirror 332 and a reflector 333, thereby selectively attenuating the potential on the outer surface of the photosensitive drum 31 to form an electrostatic latent image thereon. The developing device 34 forms a toner image on the outer surface of the photosensitive drum 31 by developing the electrostatic latent image by toner. The transfer device 35 transfers the toner image on the outer surface of the photosensitive drum 31 to the transfer sheet P. As described later, the transfer device 35 is formed by a transfer roller spaced away from the photosensitive drum 31 by a specified distance in this image forming apparatus. The cleaner 36 removes the toner still residual on the outer surface of the photosensitive drum 31 after image transfer. The charge removing device 37 removes electric charges still residual on the outer surface of the photosensitive drum 31.

The fixing assembly 40 is provided downstream from the image transferring assembly 30 with respect to a sheet transporting direction, and heats the transfer sheet P having the toner image transferred thereto in the image transferring assembly 30 while holding it between a heating roller 41 and a pressure roller 42 pressed against the heating roller 41, thereby fixing the toner image onto the transfer sheet P.

The image reading assembly 50 reads image information of an original placed on a glass platen 51 by causing an exposure lamp 52 to project a light onto the original, and introducing the light reflected by the original to a photoelectric converting section 56 comprised of a CCD line sensor or the like via reflectors 55*a*, 55*b*, 55*c*. The exposure lamp 52 and the reflector 55*a* construct a scanning section 57, which transversely moves in an area 58 of FIG. 1 at a specified speed to scan the entire surface of the original placed on the glass platen 51, thereby reading the image on the entire surface of the original.

Further, in order to detect an absolute humidity condition of an apparatus installation environment, a temperature sensor for detecting a temperature of the apparatus installation environment and a relative humidity sensor for detecting a relative humidity thereof are provided in this image forming apparatus. These sensors 61, 62 may be provided outside the apparatus if they can detect the absolute humidity condition of the apparatus installation environment.

Next, the construction of the transfer roller 35 and its peripheral devices of this image forming apparatus are described.

Figure 2:
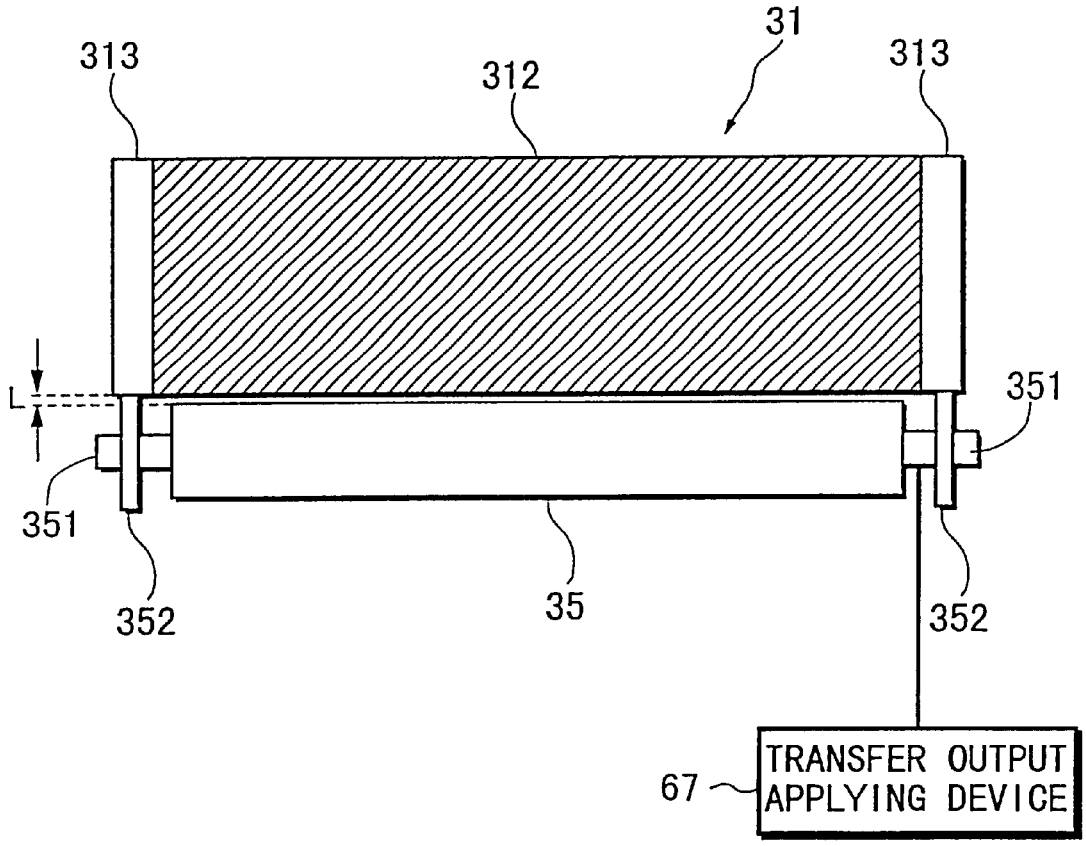
FIG. 2 is a front view of a transfer roller.

FIG. 2 is a front view of the transfer roller 35. The photosensitive drum 31 is formed of an OPC drum having a diameter of 30 mm, and a photosensitive layer 312 is formed on the outer surface thereof except opposite ends 313.

The transfer roller 35 is made of a electrically conductive solid urethane having a volume resistivity of 4.0 to 25.1 MΩ, an Asker C hardness of 75±3, a surface roughness Rz of 10 $\mu$m or smaller, and a diameter of 14.2 mm, and a core member 351 having a diameter of 8 mm is inserted into the center axis of the transfer roller 35. Transfer wheels 352 having a diameter of 15 mm which is larger than that of the transfer roller 35 are mounted on the core member 351 at the opposite sides of the transfer roller 35. The transfer wheels 352 are held in contact with the outer surfaces of the opposite ends 313 of the photosensitive drum 31, with the result that the transfer roller 35 is spaced away from the photosensitive drum 31 by a specified distance $L \approx 0.5$ mm.

In this apparatus, the specified spacing L is securely defined between the outer surfaces of the transfer roller 35 and the photosensitive drum 31 by a simple construction, i.e., by holding the transfer wheels 352 at the opposite sides of the transfer roller 35 in direct contact with the photosensitive drum 31.

Since the transfer roller 35 is not in contact with the outer surface of the photosensitive drum 31 in this apparatus, it lessens the abrasion of the photosensitive layer 312 on the outer surface of the photosensitive drum 31, thereby increasing the lifetime of the photosensitive drum 31. Further, the transfer roller 35 can be made of any desired material which is sufficiently harder than those used for transfer rollers to be held in contact with the outer surface of the photosensitive drum 31 and is unlikely to be abraded or damaged. Furthermore, the surface roughness of the transfer roller 35 can be properly set according to the particle diameter of the toner.

Since thickness t of transfer sheets P used in general is 0.1 to 0.15 mm, an air layer having a specified electric resistance value is constantly formed between the photosensitive drum 31 and the transfer roller 35 even if the sheet P is present between the photosensitive drum 31 and the transfer roller 35, thereby preventing a flow of an excessive transfer current.

Further, an electric field is formed between the photosensitive drum 31 and the transfer roller 35 by applying a specified transfer output to the core member 351 of the transfer roller 35 by a transfer output applying device 67. The toner image on the photosensitive drum 31 is transferred to the sheet P by the action of this electric field.

During a normal image transfer step, a transfer output having a polarity opposite to that of the toner is applied to the transfer roller 35, and the toner forming the toner image on the photosensitive drum 31 is attracted to the transfer roller 35. However, since the sheet P is present between the photosensitive drum 31 and the transfer roller 35, the toner is ideally not adhered to the transfer roller 35. During a non-image-transfer period, the toner is not adhered to the transfer roller 35 since the toner is ideally not adhered to the photosensitive drum 31. However, since the transfer roller 35 is provided in proximity to the photosensitive drum 31 to which the toner is adhered, it is difficult to completely prevent even a slight amount of toner from being adhered to the transfer roller 35 during the image-transfer period as well as during the non-image-transfer period.

The adhesion of the toner to the transfer roller 35 causes a problem that the toner is further adhered to the rear surface of the transfer sheet P in contact with the transfer roller 35, thereby smearing the rear surface of the transfer sheet P. Not only the toner, but also external matters such as paper powder may be adhered to the transfer roller 35. The toner and the external matters such as paper powder adhered to the transfer roller 35 make the outer surface of the transfer roller 35 coarse, with the result that a desired transfer output cannot be obtained to thereby cause a transfer failure.

Accordingly, this image forming apparatus is provided with a cleaner unit 70 for removing the toner and the external matter including paper powder adhered to the transfer roller 35.

Figure 3:
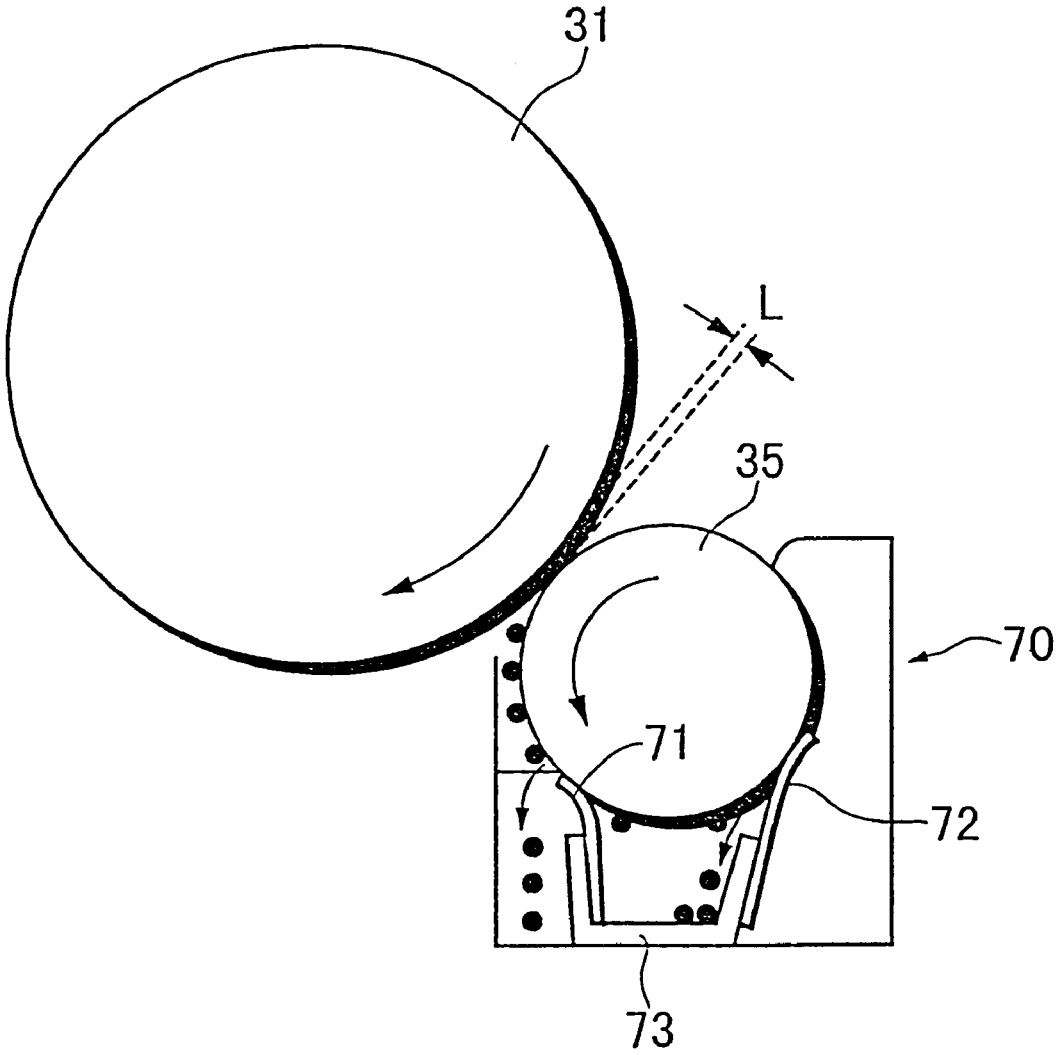
FIG. 3 is a side view of the transfer roller.

FIG. 3 is a side view of the transfer roller 35. As shown in FIG. 3, the transfer roller 35 has most of its outer surface covered by the cleaner unit 70, in which two cleaning blades 71, 72 formed of a PET film are so provided as to be in contact with the outer surface of the transfer roller 35. The two cleaning blades 71, 72 are both directly adhered to a mount 73 and are held in contact with the transfer roller 35.

Since the transfer roller 35 is allowed to have a relatively high hardness in this apparatus as described above, the cleaning blades 71, 72 in contact with the transfer roller 35 may be made of a relatively hard material without damaging the outer surface of the transfer roller 35. For example, besides the PET film, blades may be made of a variety of synthetic resin materials and rubbers, felt and the like. In other words, the material for the blades can be selected from a wide range of materials, which enables the use of an inexpensive material.

Further, the cleaning blades 71, 72 can be pressed against the transfer roller 35 with a relatively large force without damaging the outer surface of the transfer roller 35. Thus, the toner and the external matters such as paper powder adhered to the outer surface of the transfer roller 35 can be sufficiently removed by being scraped off.

The pressing force of the cleaning blades 71, 72 against the transfer roller 35 need not be highly accurate in its intensity provided that it is above a predetermined value. Therefore, a lower production cost for the apparatus can be realized by adopting a simple construction of directly adhering the cleaning blades 71, 72 to the mount 73.

The cleaning blade 71 is so disposed as to extend in a direction opposite to the rotating direction of the transfer roller 35, whereas the cleaning blade 72 is so disposed as to extend in the rotating direction of the transfer roller 35. Accordingly, the cleaning blade 71 extending in the direction opposite to the rotating direction of the transfer roller 35 scrapes off the toner, paper powder and the like while almost biting in the outer surface of the transfer roller 35, and the cleaning blade 72 extending in the rotating direction of the transfer roller 35 does so while pressing the outer surface of the transfer roller 35. Thus, by holding the two cleaning blades 71, 72 in contact with the transfer roller 35 in different manners, the toner and paper powder adhered to the outer surface of the transfer roller 35 in various manners can be effectively removed.

Figure 4:
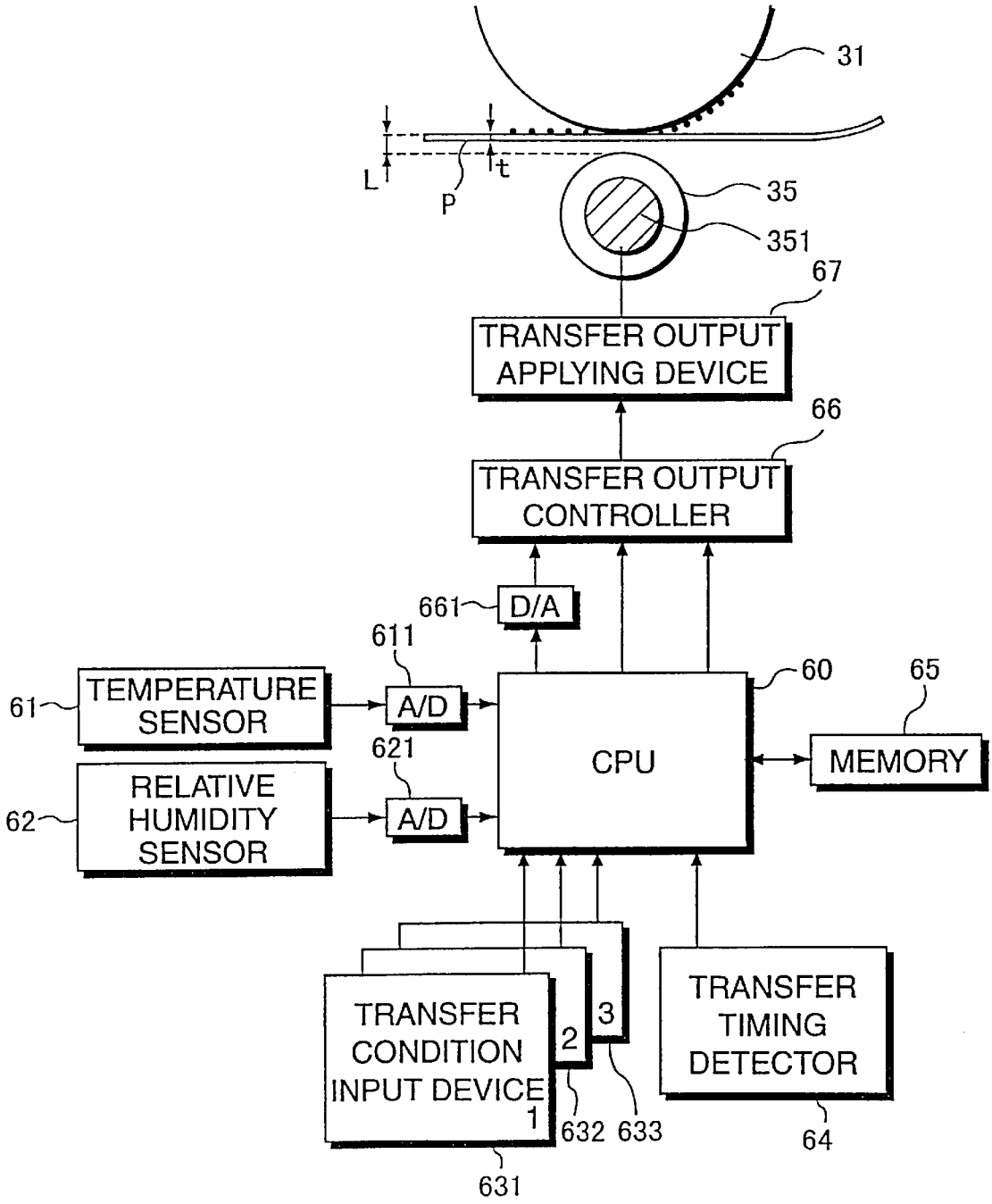
FIG. 4 is a schematic diagram showing a control system for controlling a transfer output to be applied to the transfer roller.

FIG. 4 is a construction diagram of a control system for applying the transfer output to the transfer roller 35. As described above, the transfer output is applied to the core member 351 of the transfer roller 35 by the transfer output applying device 67, which is controlled by a transfer output controller 66.

The transfer output controller 66 performs a constant-voltage control to a transfer voltage to be applied from the transfer output applying device 67 to the transfer roller 35 using a voltage value represented by a transfer voltage control signal sent from a CPU 60 via a digital-to-analog (D/A) converter 661 as a target voltage value for the constant-voltage control. To the transfer output controller 66 are also inputted a timing signal representing an application timing of the transfer output and a polarity signal representing the polarity of the transfer output.

On the other hand, various transfer conditions such as a difference between a text transfer mode for transferring a text information and an image transfer mode for transferring an image such as a picture, the size and paper quality of the transfer sheet P, and information as to on which surface of the sheet P an image is to be formed in the case that images are formed on both surfaces of the sheet P are inputted from transfer condition input devices 631, 632 and 633 to the CPU 60. The input devices 631 to 633 may be means with which a user can directly input pieces of information or may be specified detectors such as sensors.

To the CPU 60 are also inputted the temperature information and relative humidity information of the apparatus installation environment detected by the temperature sensor 61 and the relative humidity sensor 62 after being converted into digital values by analog-to-digital (A/D) converters 611, 621. The CPU 60 calculates a saturated vapor amount at a temperature represented by the received temperature information, and then calculates an absolute humidity which is an absolute amount of vapor by multiplying the saturated vapor amount by the relative humidity.

These various transfer conditions and the absolute humidity condition of the apparatus installation environment influence an optimal value of the transfer output when an image is transferred to the sheet P. Thus, the CPU 60 calculates an optimal transfer output using a function and/or a data table stored in a memory 65 and sets it as a target voltage of the constant-voltage control. The CPU 60 sends this target voltage value to the transfer output controller 66 as a transfer voltage control signal.

Further, start and end timings of the image transfer step which are detected based on the position of the transfer sheet P in the apparatus are inputted from a transfer timing detector 64 to the CPU 60. This transfer timing detector 64 can be constructed, for example, by a registration switch (not shown) for detecting the leading and trailing ends of the sheet P immediately before the registration rollers 23 (see FIG. 1) provided in a sheet transport path upstream from the transfer roller 35.

The CPU 60 causes the transfer output controller 66 to perform an image transfer at a specified timing by sending to the transfer output controller 66 a timing signal representing the thus obtained specified timing.

The CPU 60 as a transfer output setting means causes a specified transfer output to be applied to the transfer roller 35 even during the non-image-transfer period to clean the toner adhered to the transfer roller 35.

Figure 5A:
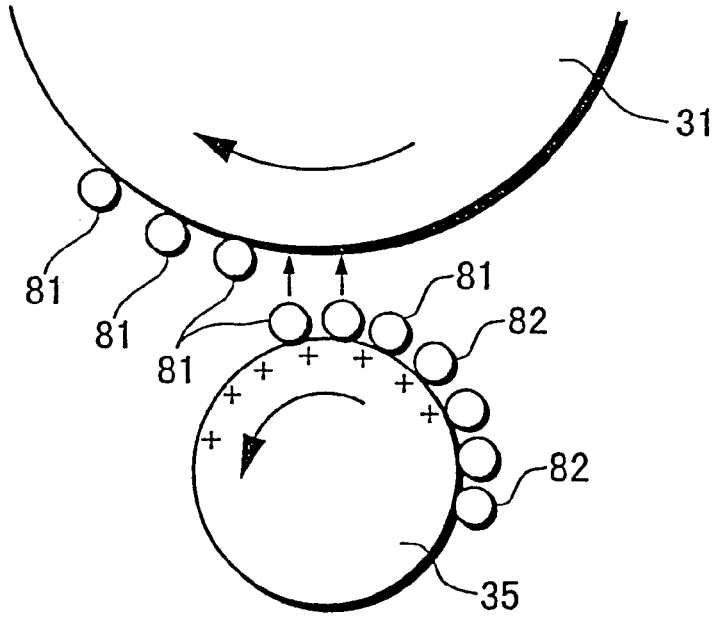
FIG. 5A is a diagram showing a first cleaning step by the application of the transfer output.
Figure 5B:
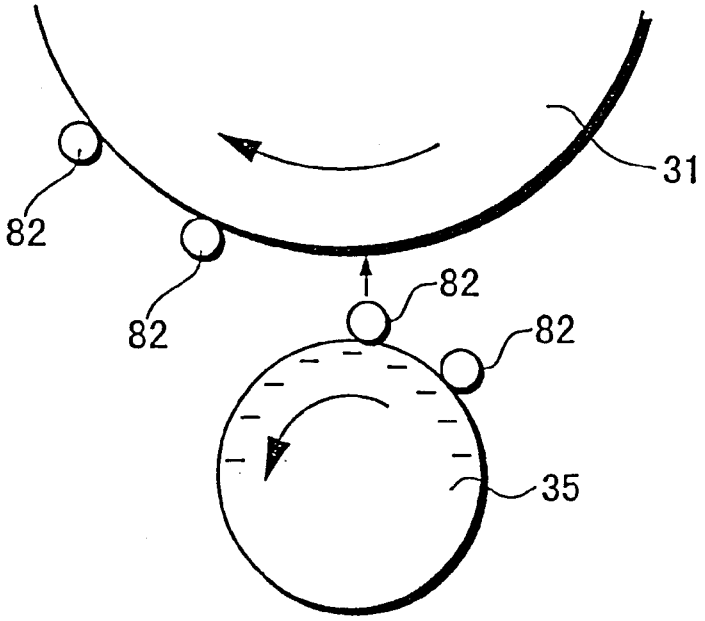
FIG. 5B is a diagram showing a second cleaning step by the application of the transfer output.

FIGS. 5A and 5B are diagrams showing an operation of cleaning the transfer roller 35 by the transfer output. In this cleaning operation, a transfer output having the same polarity as toner 81 is applied to the transfer roller 35 in a first cleaning step as shown in FIG. 5A. It should be noted that an example here shows a case where the positively charged toner 81 is used and a positive transfer output is applied to the transfer roller 35 during the cleaning operation.

In this first cleaning step, the CPU 60 as the transfer output setting means instructs the transfer output controller 66 via a polarity signal to cause the transfer output applying device 67 to apply a transfer output having the same polarity as the toner 81 to the transfer roller 35, and sets and instructs a transfer voltage sufficient for the above cleaning operation to the transfer output controller 66 by a transfer output control signal. In other words, the CPU 60 constructs the transfer output setting means for selectively setting the polarity of the transfer output.

Upon the application of the transfer output having the same polarity as the toner 81 to the transfer roller 35, the attraction of the toner, which is adhered to the outer surface of the photosensitive drum 31, to the transfer roller 35 is prevented, and the toner 81 adhered to the transfer roller 35 repels against the transfer roller 35 and is flown toward the photosensitive drum 31. Since the cleaner 36 for removing the residual toner is provided in a position around the photosensitive drum 31 as shown in FIG. 1, the toner 81 adhered to the photosensitive drum 31 is removed by this cleaner 36.

Although very few, the toner 81 contains toner particles 82 charged at the polarity (negative, here) opposite to the desired polarity (positive, here).

Accordingly in this image forming apparatus, after the first cleaning step of applying the transfer output having the same polarity (positive) as the aforementioned toner 81 to the transfer roller 35, a second cleaning step of applying the transfer output having a polarity (negative) opposite to that of the toner 81 is performed in order to remove the oppositely charged toner particles 82 adhered to the transfer roller 35 as shown in FIG. 5B.

In this second cleaning step, the CPU 60 as the transfer output setting means instructs the transfer output controller 66 via the polarity signal to cause the transfer output applying device 67 to apply a transfer output having a polarity (negative) opposite to that of the toner 81 to the transfer roller 35, and sets and instructs a transfer voltage sufficient for the above cleaning operation to the transfer output controller 66 by the transfer output control signal. By applying the transfer output having the polarity opposite to that of the toner 81, i.e., having the same polarity as the oppositely charged toner particles 82 in this way, the oppositely charged toner 82 adhered to the transfer roller 35 can be removed from the transfer roller 35 by being flown toward the photosensitive drum 31.

In this image forming apparatus, the transfer output having the polarity opposite to that of the toner 81 is applied to the transfer roller 35 after the one having the same polarity as the toner 81 during the non-image-transfer period. Accordingly, the positively (or negatively) charged toner particles 81 and the negatively (or positively) charged toner particles 82 can be thoroughly removed to clean the outer surface of the transfer roller 35, thereby securely preventing the rear surface of the transfer sheet P from being smeared.

The second cleaning step for the transfer roller 35 by the application of the transfer output having the polarity opposite to that of the toner 81 is performed together with the cleaning by the aforementioned cleaning unit 70 (see FIG. 3). Therefore, the transfer roller 35 can be more securely cleaned by these two cleaning means.

As described above, according to the inventive image forming apparatus, the transfer roller is spaced away from the outer surface of the photosensitive body by the specified distance, i.e., is not in contact therewith. Accordingly, the transfer roller is allowed to having a sufficient hardness and a surface roughness suited to the particle diameter of the toner while increasing the lifetime of the photosensitive body without damaging the outer surface of the photosensitive body. Thus, the cleaning blades held in contact with the transfer roller need not be made of a soft material lest they should damage the outer surface of the transfer roller. Further, the cleaning blades can be held in contact with the transfer roller with a relatively large pressing force. Therefore, while the production cost of the apparatus can be reduced by simplifying the mount construction of the cleaning blades, the toner and the like adhered to the transfer roller can be securely removed by pressing the cleaning blades against the transfer roller with a large force. This in turn prevents the rear surface of the transfer sheets from being smeared and ensures a stable image formation of high quality.

Although the invention is described with respect to one embodiment, the image forming apparatus according to the invention is not limited to this embodiment, but may be embodied as follows.

(1) In the foregoing embodiment, the transfer wheels 352 shown in FIG. 2 are used as a construction for spacing the transfer roller 35 from the outer surface of the photosensitive drum 31 by the specified distance. However, any arbitrary positioning means may be used provided it can securely position the transfer roller 35 away from the outer surface of the photosensitive drum 31 by a specified distance.

(2) Although the two cleaning blades 71, 72 are provided in the foregoing embodiment, one, three or more cleaning blades may be provided. However, it is preferable to arrange at least one of the cleaning blade to extend in the direction opposite to the rotating direction of the transfer roller 35.

(3) Although the transfer roller 35 is cleaned by the cleaning blades 71, 72 as well as by the application of the transfer output having the same polarity as the toner 81 in the foregoing embodiment, the cleaning means by the transfer output is not necessarily provided. Further, even if the cleaning means by the transfer output is provided, the cleaning means for applying the transfer output having the polarity opposite to that of the toner 81 may be omitted.

(4) Although a constant-voltage control system is adopted as a control system for the transfer output in the foregoing embodiment, a constant-current control system may be adopted.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus, comprising:

a photosensitive body on which a toner image is to be formed;

a transfer roller spaced away from an outer surface of the photosensitive body by a specified distance for transferring a toner image formed on the photosensitive body to a sheet;

a transfer timing detector for detecting a non-image transfer period;

a transfer output applier for applying a transfer output to the transfer roller;

a transfer output setter, responsive to the transfer timing detector, for alternately setting a polarity of the transfer output, applied to the transfer roller by the transfer output applier, at positive and negative polarities during a detected non-image transfer period; and a transfer output controller, responsive to the transfer output setter, for controlling the transfer output applier to apply the transfer output to the transfer roller at alternate polarities set by the transfer output setter thereby repelling toner having both polarities from the transfer roller.

2. An image forming apparatus according to claim 1, further comprising a cleaning blade held in contact with the transfer roller for scraping off toner from the transfer roller, wherein the cleaning blade extends in a direction opposite to the rotating direction of the transfer roller.

3. An image forming apparatus according to claim 2, further comprising another cleaning blade extending in the rotating direction of the transfer roller.

4. An image forming apparatus according to claim 1, further comprising:

the photosensitive body having opposite sides;

the transfer roller having opposite sides; and transfer wheels provided at the opposite sides of the transfer roller and having a diameter larger than that of the transfer roller, the transfer wheels contacting with outer surfaces of the opposite sides of the photosensitive body so as to define a space between the photosensitive body and the transfer roller.

5. An image forming apparatus according to claim 1, wherein the transfer output setter sets the transfer output according to an apparatus installation environment condition during an image-transfer period.

6. An image forming apparatus according to claim 1, wherein the transfer roller has a surface roughness of 10 $\mu$m or smaller.

7. An image forming apparatus according to claim 1, wherein the cleaning blade is formed of a PET film.

8. An image forming apparatus according to claim 1, wherein the transfer timing detector detects a transfer timing based on a position of a transfer sheet.

9. An image forming apparatus according to claim 1, wherein the transfer output setter sets a single alternation of the polarity of the transfer output during each non-image-transfer period.

* * * * *